US005433256A

United States Patent [19]

Vasers

[11] Patent Number: 5,433,256

[45] Date of Patent: Jul. 18, 1995

[54] PILL GUIDE AND DISPENSER TRAY

[75] Inventor: Val Vasers, Mississauga, Canada

[73] Assignee: Apotex, Inc., Weston, Canada

[21] Appl. No.: 183,443

[22] Filed: Jan. 14, 1994

[51] Int. Cl.[6] ..... B65B 1/04; B65B 3/00

[52] U.S. Cl. ..... 141/370; 141/391; 141/332; 209/614

[58] Field of Search ..... 141/98, 391, 331, 332, 141/333, 334, 370, 372, 375, 363, 365, 366, 340–342; 209/614; 414/675

[56] References Cited

U.S. PATENT DOCUMENTS

| | | | |
|---|---|---|---|
| 117,723 | 8/1871 | Baker | 141/334 X |
| 142,917 | 9/1873 | Johnson | 141/334 X |
| 2,116,979 | 5/1938 | Moller | 141/365 |
| 2,739,464 | 3/1936 | Smith | 141/334 |
| 2,812,784 | 11/1957 | Palmer | 141/333 X |
| 3,169,643 | 2/1965 | Roberts | 141/340 |
| 3,628,659 | 12/1971 | Mitchell | 209/614 |
| 4,261,683 | 4/1981 | Zaleon | 414/675 |
| 4,607,671 | 8/1986 | Aalto et al. | 141/329 |
| 4,872,494 | 10/1989 | Coccia | 141/383 |
| 4,913,201 | 4/1990 | Lucero | 141/334 |
| 5,092,471 | 3/1992 | Pinizzotto et al. | 209/614 |
| 5,117,982 | 6/1992 | Shotthafer et al. | 209/614 |

FOREIGN PATENT DOCUMENTS

| | | | |
|---|---|---|---|
| 7201 | 12/1904 | United Kingdom | 141/365 |

*Primary Examiner*—Robert M. Fetsuga
*Assistant Examiner*—Steven O. Douglas
*Attorney, Agent, or Firm*—Caesar, Rivise, Bernstein, Cohen & Pokotilow, Ltd.

[57] ABSTRACT

A pill guide for use in combination with pill, capsule and caplet dispensing trays has a tapered guide channel for removable attachment to the pill return outlet of the tray. The guide combines with adjacent wall portions of the tray return outlet to form a convergent funnel, through which unwanted pills may be discarded back to the bulk supply from where they came. The pill guide may incorporate a guidance lip to facilitate alignment of the tray with the bulk receptacle.

12 Claims, 4 Drawing Sheets

PILL GUIDE AND DISPENSER TRAY

FIELD OF THE INVENTION

This invention is directed to a pill dispenser and in particular to a removable unitary pill guide for use in combination with a pill dispenser tray.

BACKGROUND ART

Pill dispenser trays enjoy widespread use in pharmacies in the dispensing of drugs by pharmacists.

The dispenser trays usually include a planar counting table portion onto which a supply of the drug to be dispensed, in tablet form, is deposited from a bulk supply.

A collection channel located to one side of the counting table receives pills as they are counted off by the pharmacist and displaced into the channel. A hinged cover to the channel can isolate the channel when the required quantity of pills has been deposited therein.

A pill return outlet permits the decanting of excess pills remaining upon the counting table, back to the bulk supply.

It should be understood that certain medications comprise pills of very small size, particularly in the case of certain more potent medications, for which very precise accounting is required.

In view of the immediacy of the specific number of pills that have been counted in response to a prescription, there is a potential tendency to carelessness in the handling of the remainder or "discard", which are returned to stock. Also, the presence of the bulk supply of stock, due to the sheer number of the bulk supply, tends to de-emphasize the importance of individual discard pills, as the attention of the pharmacist is focused upon accurate filling of the ordered prescription.

As a consequence, a psychological tendency may exist that "discard" drugs can be handled carelessly, and spillage can occur, with the consequent danger of loss or misappropriation of the spilled pills or tablets.

The possible use of a type of separate funnel is inappropriate, in view of the wide variation in the size of bulk containers to which discard pills etc. must be returned, with the consequent need to employ both hands, plus the initial necessity of locating the funnel. Also, a funnel may not be readily dry cleaned, as with a paper towel.

DISCLOSURE OF THE INVENTION

It will be understood that in the following the term "pill" may also encompass caplets and other tablet forms.

The present invention provides a clip-on pill guide for use with a pill dispenser, the guide having a guide passage portion with an inlet end and an outlet end, and attachment means for attaching the guide passage portion in detachable secured relation to the pill dispenser.

In a preferred embodiment the subject guide provides an open, guiding channel, enabling the ready dry cleaning of the interior surface thereof, such as with a paper towel or tissue. The existence of damaged tablets may raise the possibility of cross contamination, with a consequent need for ready, dry-wipe cleaning.

A further embodiment incorporates a locator lip extending forwardly of the outlet end of the guidance passage portion, to facilitate alignment of the pill guide with an inlet to a pill receptacle, and to promote safe passage of pills thereto.

The preferred guide is provided with a passage portion of tapered section, affording a funnel-like convergence, when attached to an outlet corner of a pill dispenser.

The guide attachment means may comprise resilient clips to engage adjacent portions of a pill dispenser tray adjacent the corner thereof, to precisely position the guide in removable relation therewith.

In one preferred embodiment the attachment means comprises a pair of locating slide clips, one on each side of the pill guide, and slidable over edge portions of one corner of a dispenser tray; with a circular, or part-circular resilient clip ring portion to encircle an outlet portion of the tray and position the subject guide into a composite funnel form with adjoining portions of the corner of the tray.

BRIEF DESCRIPTION OF THE DRAWINGS

Certain embodiments of the invention are described by way of illustration without limitation of the invention thereto, including an illustration of a prior art pill dispenser suited for use in combination with the present invention, reference being made to the accompanying drawings, wherein.

BEST MODE OF CARRYING OUT THE INVENTION

Figure 1:
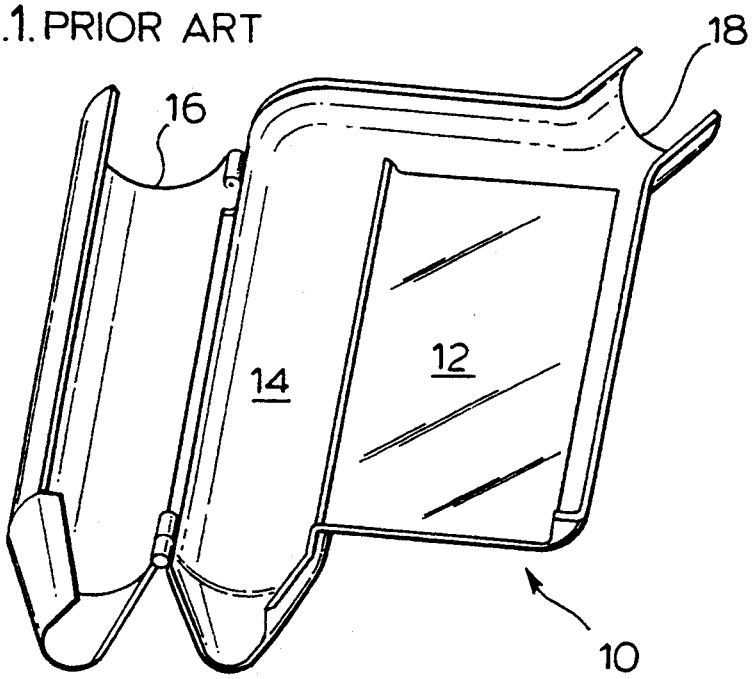
FIG.1. PRIOR ART
FIG. 1 is a perspective view of a prior art pill dispenser tray with which the subject guide may be combined.

Referring to FIG. 1, this prior art pill dispenser tray 10 has a planar counting table portion 12, and a collection channel 14 with hinged cover 16.

A pill return outlet 18 occupies a corner of the counting table remote from the collection channel 14, having a corner inlet and a projecting corner outlet; through which outlet 18 discarded pills may be decanted into their bulk container.

Figure 2:
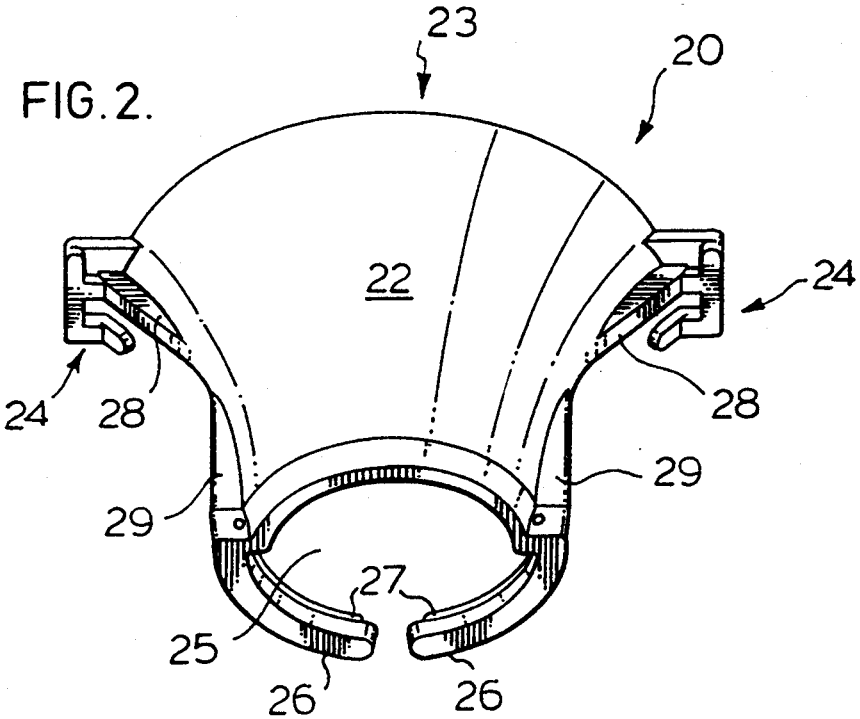
FIG. 2 is a front perspective view of the subject pill guide.
Figure 3:
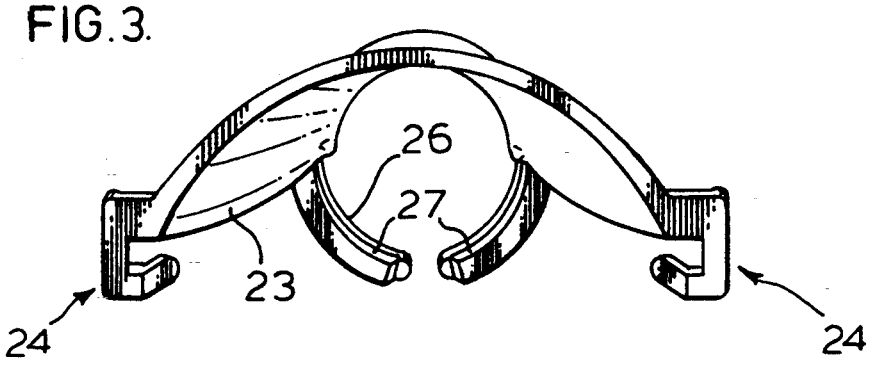
FIG. 3 is an end view, looking towards the inlet of the subject pill guide.

Referring to FIG. 2, the subject pill guide 20 has an arcuately tapered, semi-circular guide wall 22, with enlarged inlet end 23 and diminished outlet end 25.

A pair of locating side clips 24, located at inlet end 23 enable sliding engagement with the side edges of the counting table 12, adjacent the return outlet 18.

A pair of resilient clip ring portion means 26 to encircle the return outlet 18 of the tray 10 project downwardly adjacent the outlet end 25 of the guide 20.

The clip ring portion means 26 have recessed inner lip portion 27 to engage a lip portion of pill return outlet 18 in precise registry therewith.

Web portions 28, 29 of the guide 20 serve to reinforce the wall 22, and to provide a precise fit over the upper surface of pill return outlet 18.

Figure 6:
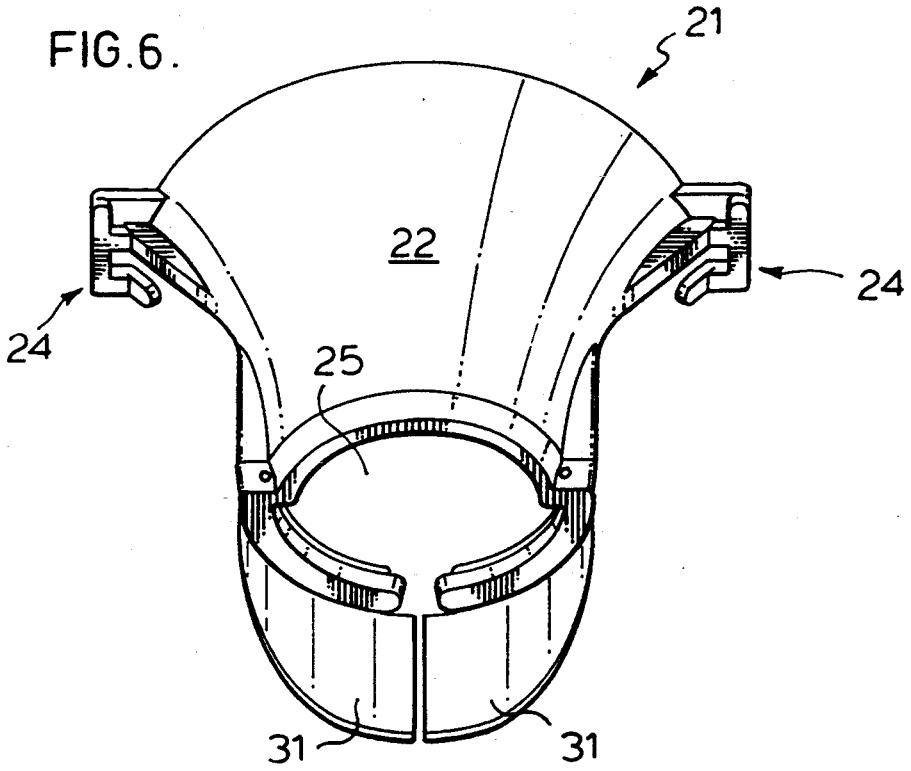
FIG. 6 is a front perspective view of an alternative embodiment with receptacle guide; and, FIG. 7 is a front perspective view of the subject pill guide and corner portion of the pill dispenser tray upon which it is mounted.
Figure 4:
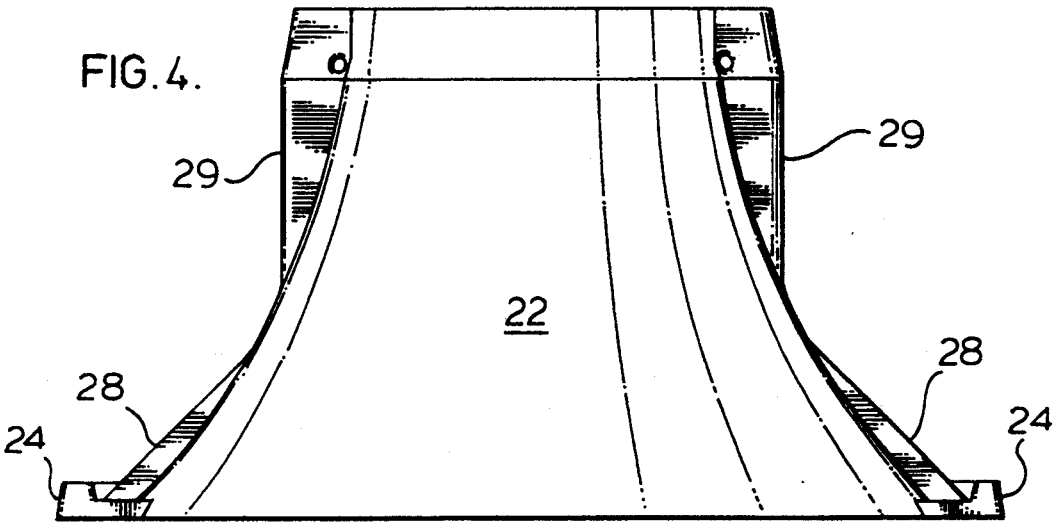
FIG. 4 is a top view of the pill guide.
Figure 5:
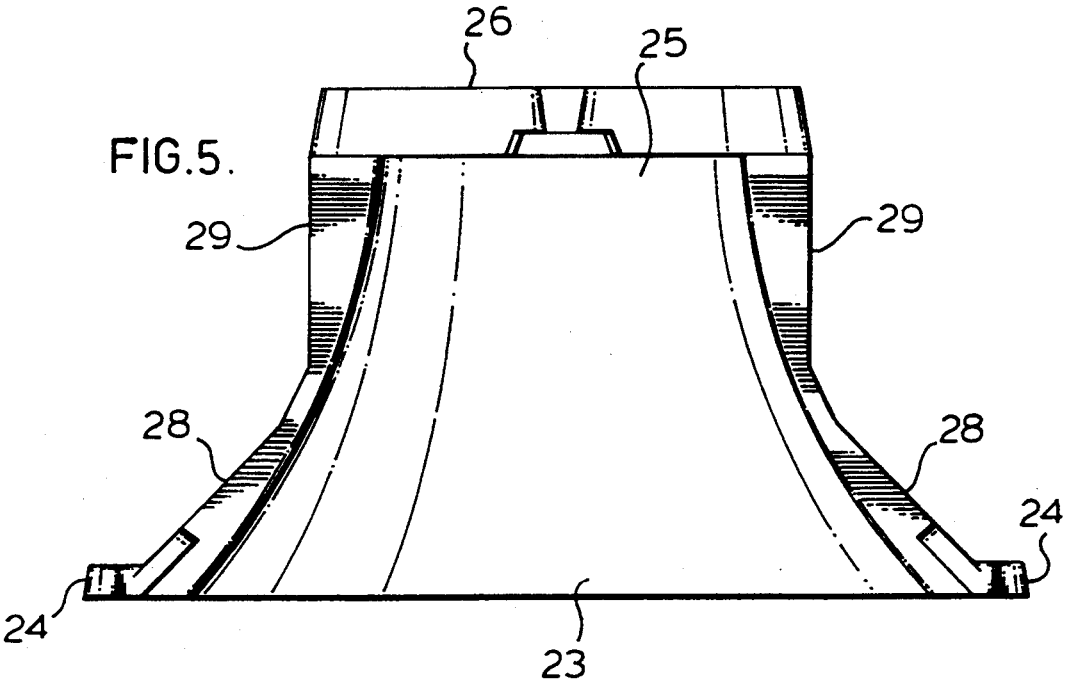
FIG. 5 is a bottom view of the pill guide.

Referring to FIG. 6, the outlet end 25 of pill guide 21 has extended apron or locator lip portions 31, to serve as a guide or locator lip and to promote the safe pouring of pills etc. therepast.

Figure 7:
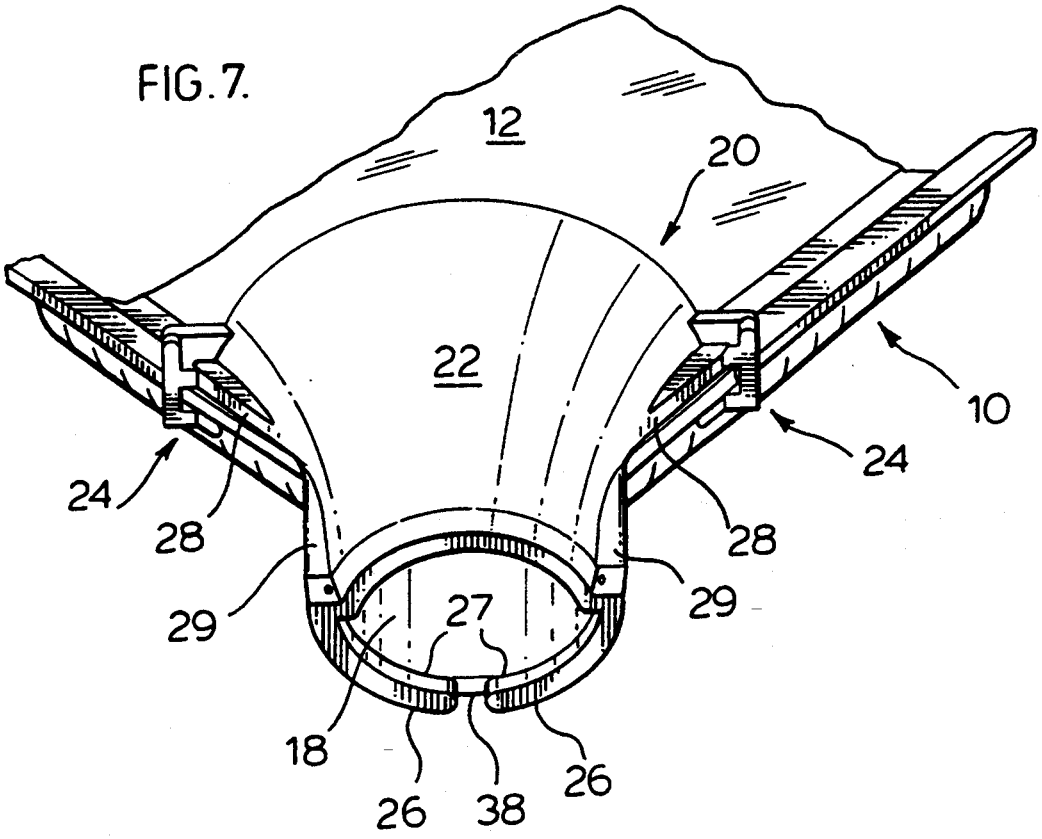

In FIG. 7 it can be seen how the pill guide 20 secures in slip on clipped relation to edge flange portions of the dispenser tray 10, by way of the edge clips 24 and clip ring portions 26 which engage lip portion 38 of return outlet 18 of the tray 10.

COMMERCIAL APPLICATION

The subject pill guide has great practical utility and a wide market potential.

What I claim by Letters Patent of the United States is:

1. A combination of a pill dispenser tray and a clip-on pill guide, said pill dispenser tray having a planar tray portion and an open pill return having an open corner inlet and a projecting open corner outlet, said guide having a guide passage portion, with an open inlet end and an open outlet end; and resilient clip attachment means for attaching the guide passage portion in detachable secured, slip-on clipped relation to said pill dispenser tray, to form an enclosed out passage with said pill return corner outlet.

2. The combination as set forth in claim 1, said guide passage portion being of tapered section, to facilitate the funneling of fluent, particulate material therethrough, for deposition thereof into a container.

3. The combination as set forth in claim 2, said guide passage portion comprising a cover, for attachment to said pill dispenser tray in covering relation with said corner outlet portion of the dispenser; said attachment means including downwardly projecting clip means to engage said pill dispenser in cover-securing relation therewith.

4. The combination as set forth in claim 3, having said cover in overlying relation with said dispenser tray corner outlet, forming an outlet funnel, in use to guide said pills in return outflow therethrough.

5. The combination as set forth in claim 2, said tapered section having an enlarged entry portion and a diminished exit portion, the guide including resilient clip means projecting therefrom, for attachment of the guide in removably secured, oriented relation with said dispenser tray.

6. The combination as set forth in claim 5, said clip means securing said guide in removably secured relation to said dispenser tray open outlet ends to form a tapered outlet funnel.

7. The combination as set forth in claim 2, said tapered section comprising a substantially open channel, to provide ready access to the whole inner surface thereof.

8. The combination as set forth in claim 2, having said tapered guide passage portion overlying a tapered portion of said dispenser tray, in funnel-forming relation therewith.

9. The combination as set forth in claim 1, having said pill guide in secured clipped-on relation to said pill dispenser tray, to provide an enclosed, funnel-like, outwardly extending pill return.

10. The combination as set forth in claim 1, said pill guide including locating lip means extending outwardly therefrom adjacent said guide passage outlet end, to facilitate positioning of said dispenser tray outlet end in relation to a container positioned to receive pills from the dispenser tray.

11. The combination as set forth in claim 1, said dill guide attachment means including a substantially circular, resilient clip ring portion to releasably engage and at least partially encircle said outlet portion of said corner of said pill dispenser tray in attaching and precise locating relation Of said pill guide therewith.

12. The combination as set forth in claim 11, said pill guide attachment means further including side clip portions remote from said pill guide passage outlet end, extending laterally from the guide to engage adjoining projecting edge portions of said dispenser tray located adjacent said tray corner in removable, attached relation therewith.

* * * * *